US008245955B2

(12) United States Patent
Yurtseven

(10) Patent No.: US 8,245,955 B2
(45) Date of Patent: Aug. 21, 2012

(54) FUEL INJECTION DEVICE

(75) Inventor: Günger Yurtseven, Regensburg (DE)

(73) Assignee: Continental Automotive GmbH, Hannover (DE)

( * ) Notice: Subject to any disclaimer, the term of this patent is extended or adjusted under 35 U.S.C. 154(b) by 524 days.

(21) Appl. No.: 12/493,676

(22) Filed: Jun. 29, 2009

(65) Prior Publication Data

US 2010/0038457 A1 Feb. 18, 2010

(30) Foreign Application Priority Data

Jul. 8, 2008 (DE) ..... 10 2008 032 133

(51) Int. Cl.
*F02M 61/10* (2006.01)

(52) U.S. Cl. ..... 239/533.11; 239/533.2

(58) Field of Classification Search ..... 239/533.2, 239/533.11, 533.12, 102.2, 584, 585.3, 585.4, 239/585.5

See application file for complete search history.

(56) References Cited

U.S. PATENT DOCUMENTS

| | | | | |
|---|---|---|---|---|
| 5,544,816 | A * | 8/1996 | Nally et al. | 239/585.5 |
| 5,921,475 | A * | 7/1999 | DeVriese et al. | 239/585.4 |
| 6,405,946 | B1 * | 6/2002 | Harata et al. | 239/533.12 |
| 7,419,103 | B2 * | 9/2008 | Pauer | 239/88 |
| 2002/0189632 | A1 * | 12/2002 | Glock et al. | 134/1 |

* cited by examiner

*Primary Examiner* — Davis Hwu
(74) *Attorney, Agent, or Firm* — King & Spalding L.L.P.

(57) ABSTRACT

The occurrence of leaks can be reduced by a fuel injection device (10) for injecting fuel into the combustion chamber of an internal combustion engine, wherein the fuel injection device (10) has an injection valve element (14) with a first section (26) on which a guide bearing element (20) is arranged, with provision being made for a first pressure chamber (22) in an area around the guide bearing element (20).

23 Claims, 5 Drawing Sheets

FUEL INJECTION DEVICE

CROSS-REFERENCE TO RELATED APPLICATIONS

This application claims priority to DE Patent Application No. 10 2008 032 133.8 filed Jul. 8, 2008, the contents of which is incorporated herein by reference in its entirety.

TECHNICAL FIELD

The invention relates to a fuel injection device for a fuel injection system such as a common rail system for example.

BACKGROUND

A typical option for supplying internal combustion engines with fuel is fuel injection systems which have a number of fuel injectors or fuel injection devices. At the moment, in the case of self-igniting internal combustion engines, high-pressure reservoir fuel injection systems or common rail systems are being used. The fuel injectors or fuel injection devices that can be supplied with fuel by means of a common rail system are controlled by means of magnetic valves or piezoactuators.

In the case of fuel injectors which are used in piezo common rail (PCR) systems, the control device is embodied as a piezo element. In this process, an injection valve component that is embodied needle-shaped can be controlled directly by changing the electric voltage at a piezoactuator. When current is applied to the piezoactuator, the piezoelectric crystal stack experiences for example a lengthening that disappears again when the current is no longer applied.

In the case of piezo common rail (PCR) injectors, a really high fuel leakage occurs via the needle guide at the nozzle. It is known that the leakage to a strong degree depends on the diameter of the guide and on the ring gap belonging to it between the nozzle needle and the nozzle body as well as on the fuel and the ring gap length. At the moment, manufacturing a smaller guide diameter, i.e. for example of less than 4 mm, is expensive. On the one hand, a leakage leads to a heating of the fuel. On the other hand, the leakage must be compensated for by means of a higher supply performance of the fuel pump. The leakage must therefore be minimized as far as possible. During operation, as a result of the elastic deformation in the needle guide with increasing fuel pressure, the ring gap of the PCR injector tends to become greater, which causes the increase in the leakage to be increased considerably.

In order to counter the occurrence of leaks, the nozzle needle, and the nozzle body have thus far been paired in order to achieve in this way a smaller clearance in the ring gap in the PCR injectors. However, in the case of future applications aiming for pressures of 1800 bar and higher, there is likely to be a further increase in the leakage.

SUMMARY

According to various embodiments, a fuel injection device can be provided with which the occurrence of leaks can be reduced.

According to an embodiment, a fuel injection device for injecting fuel into the combustion chamber of an internal combustion engine may have an injection valve element with a first section, on which a guide bearing element is arranged, with a first pressure chamber being provided in an area around the guide bearing element.

According to a further embodiment, the first pressure chamber may be around an area of the guide bearing element for example a high pressure chamber. According to a further embodiment, a second pressure chamber can be formed between the inside of the guide bearing element and the end of the injection valve element, with the second pressure chamber being a low pressure chamber for example. According to a further embodiment, a clearance between the guide bearing element and the first section of the injection valve element can be reduced by applying pressure to the first pressure chamber for example a pressure in a range of up to 1000 bar and higher and/or of up to 1800 bar and higher and/or of up to 2000 bar and higher. According to a further embodiment, the injection valve element can be arranged in a movable manner in a nozzle body device. According to a further embodiment, the guide bearing element can be pressed against an injector body device or an stop element can be pressed against the injector body device for example to seal it or essentially to form a seal. According to a further embodiment, provision may for example be made for at least one spring element in order to press the guide bearing element on the injection valve element with the injection valve element additionally having been provided with a collar section in order to support the spring element, with at least one adjusting element or a number of adjusting elements able to be arranged for example between the collar section and the spring element. According to a further embodiment, the injection valve element may have a second section, which is paired with the nozzle body device, with the second section having one, two, three, four or a number of recesses for fuel to pass through for example, with the recesses being embodied in the form of beveled surfaces and/or cavities for example. According to a further embodiment, the injection valve element may have a third section, which with its end in a closed position of the fuel injection device closes off the specific injection opening or the relevant injection openings of the fuel injection device. According to a further embodiment, the third section of the injection valve element may form a gap or a ring gap with the nozzle body device. According to a further embodiment, provision may be made for example for a piezoactuator as the control device in order to control the injection valve element. According to a further embodiment, the control device may have a control piston element by means of which the injection valve element can be controlled, with a stroke adjusting pin element also able to be arranged for example in a movable manner between the control piston element and the injection valve element, with the stroke adjusting pin element being able for example to be paired with the injector body device or the stop element. According to a further embodiment, provision may be made for at least one fuel supply in the fuel injection device by means of which fuel can be supplied to the high pressure chamber. According to a further embodiment, the clearance between the guide bearing element and the injection valve element may lie in a range from 7 μm to 8 μm for example and/or the clearance between the second section of the injection valve element and the nozzle body device in a range from 2 μm to 3 μm for example. According to a further embodiment, the guide bearing element and/or the injection valve element may be at least embodied in the area of the pairing with the guide bearing element in a cylindrical or in a cylindrically tapered manner. According to a further embodiment, the guide bearing element and/or the injection valve element may be at least embodied in the area of the pairing with the guide bearing element as a cone or in a conically tapered manner, with the cone of the guide bearing element and/or the injection valve element being tapered upwards or towards the end. According to a further embodiment, the guide bearing element can be embodied as a cylinder and the injection valve element at least in the area of the pairing with the guide bearing element is embodied in a conical or in a conically tapered manner, with the cone for example being tapered upwards or towards the end. According to a further embodiment, a first, lower end of the guide bearing element may form a clearance with the injection valve element which for example lies in a range from 2 μm to 3 μm and/or a second, upper end of the guide bearing element forms with the injection valve element, a clearance for example in a range from 10 μm to 12 μm or 10 μm to 13 μm or 10 μm to 16 μm. According to a further embodiment, the guide bearing element can be embodied as a cone and the injection valve element, at least in the area of the pairing with the guide bearing element, is embodied in a conical or in a conically tapered manner, with the cone being tapered upwards or towards the end for example. According to a further embodiment, provision may be made for at least two or three steps, with the clearance of the guide gap between the guide bearing element and the injection valve element increasing for example towards the end of the injection valve element, with in the case of the first step, the clearance of the guide gap for example lying in a range from 1 μm to 2 μm, the clearance of the guide gap of the second step for example lying in a range from 4 μm to 5 μm and the clearance of the guide gap of the third step for example lies in a range from 10 μm to 25 μm. According to a further embodiment, the guide bearing element for example may have a wall strength ranging from approximately 1 mm to approximately 1.4 mm, with the wall strength of the guide bearing element able to be constant throughout or able to vary. According to a further embodiment, the guide bearing element for example may consist of 18CrNi8 or features this element.

BRIEF DESCRIPTION OF THE DRAWINGS

An exemplary embodiment is described in more detail below with reference to the schematic figures of the drawings, in which.

In all the figures in the drawings the same reference characters refer to the same or functionally comparable elements and devices unless stated otherwise.

DETAILED DESCRIPTION

Figure 1:
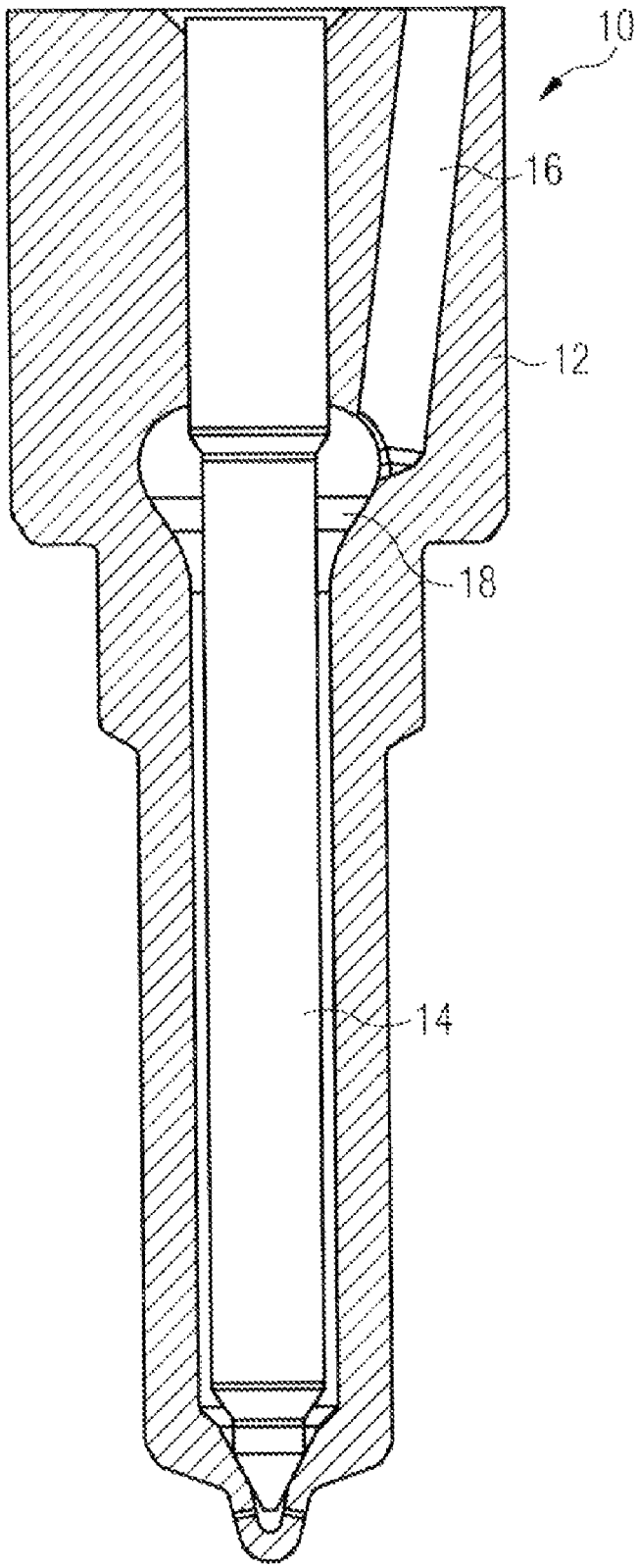
FIG. 1 shows a section of a conventional fuel injection device in a cross-sectional view.

According to various embodiments, a fuel injection device to inject fuel into the combustion chamber of an internal combustion engine may have an injection valve element on which a guide bearing element is arranged and with a first pressure chamber being provided in an area around the guide bearing element.

The guide bearing element and the first pressure chamber arranged around the guide bearing element have the advantage that the clearance between the guide bearing element and the injection valve element can be reduced. As a result, a leakage can for example be reduced to a nearby chamber or pressure chamber or to a second chamber or pressure chamber separated by means of the guide bearing element. By applying pressure to the (first) pressure chamber around the guide bearing element, for example by means of supplying fuel from a common rail, the clearance between the guide bearing element and the injection valve element can be reduced. By applying pressure to the first pressure chamber during operation at for example high pressures of up to 2.000 bar and higher, the guide bearing element is deformed elastically or compressed. In this process, the clearance of the gap between the guide bearing element and the injection valve element is reduced. The reduction of the gap or the ring gap leads to a reduction of the leakage of the pressurized fuel in the first pressure chamber through this gap between the guide bearing element and the injection valve element.

In an embodiment, the guide bearing element can press against an injector body device or a stop element of the injector body device, to seal it in a preferred manner. In this way, the pressure chambers formed by the guide bearing element and the injection valve element can be sealed off from one another.

In another embodiment, the guide bearing element forms a high pressure chamber and a low pressure chamber in conjunction with the injection valve element. In this case, the low pressure chamber is formed between the inside of the guide bearing element and the injection valve element. On the other hand, the high pressure chamber is again formed between the outside of the guide bearing element and the outside of the injection valve element and the nozzle body device. In this case, by means of pressing the guide bearing element against the injector body device (holding device), the two pressure chambers with different pressures can be sealed off from one another.

In a further embodiment, provision has for example been made for at least one spring element in order to press the guide bearing element against the injection valve element. In this case, the injection valve element can for example be supplied with a stop in order to brace the spring element. In this process, for example at least one bearing retainer element or a number of bearing retainer elements can in addition be arranged between the stop and the spring element in order to adjust the spring element or its spring element in a suitable manner so that the spring element for example presses against the guide bearing element in a manner so as to provide a sufficient seal.

In accordance with another embodiment, the injection valve element has a second section, which is paired with the nozzle body device. In this embodiment, the second section is embodied in such a way that said section makes provision for fuel to pass through. For this purpose, the second section of the injection valve element for example has one, two, three, four or more recesses for fuel to pass through. In this process, the recesses can for example be embodied in the form of beveled surfaces and/or cavities, to give just two examples.

In a further embodiment the injection valve element has a third section, which with its end in a closed position closes off the specific injection opening or the relevant injection openings of the fuel injection device. In this case, the third section of the injection valve element forms a gap or a ring gap with the nozzle body device, in which fuel is supplied via the second section. If the third section opens the specific injection opening when in an open position, the fuel can then be injected through these openings into a cylinder.

In another embodiment, provision has for example been made for a piezoactuator as a control device in order to control the injection valve element. A piezoactuator has the advantage that it has very short switching times. However, instead of a piezoactuator, provision can also be made for any other kind of actuator that is suitable for controlling the injection valve element. The invention is not limited to one piezoactuator.

In accordance with a further embodiment, the control device has a control piston element by means of which the injection valve element can be controlled. By withdrawing the control piston element, the injection valve element can be moved into an open position. In addition, a stroke adjusting pin element can be arranged in a movable manner between the control piston element and the injection valve element as an option or said stroke adjusting pin element can be embodied in one piece with the control piston element. In this case, the stroke adjusting piston element can for example be paired with the injector body device or with the stop element.

In a further embodiment, provision has at least been made for a fuel supply into the fuel injection device. By means of this fuel supply, fuel is for example supplied from a common rail system into the high pressure chamber of the fuel injection device.

In another embodiment, the clearance between the guide bearing element and the injection valve element for example lies in a range between 7 μm and 8 μm on assembly, i.e. at a pressure of 0 bar. This clearance is reduced by means of the elastic deformation of the guide bearing element and for this reason a leakage is also reduced. In particular, at high pressures of up to 2000 bar and higher, the clearance can be reduced in this way and a leakage can thus be countered. The play between the second section of the injection valve element and the nozzle body device can for example lie in a range between 2 μm and 3 μm on assembly at a pressure of 0 bar.

In a further embodiment, the guide bearing element and the injection valve element are embodied as a cylinder at least in the area of the pairing with the guide bearing element. This has the advantage that the two parts can be manufactured in a particularly easy and cost effective manner.

In accordance with a further embodiment, the guide bearing element or the injection valve element can be embodied as a cone manner at least in the area of the pairing with the guide bearing element whereas the other part is embodied as a cylinder in each case. In this process, the clearance between the guide bearing element and the injection valve element can be selected larger at the upper end of the guide bearing element than at the lower end of the guide bearing element. The clearance at the upper end of the guide bearing element can be larger because in this area the guide bearing element is more greatly deformed or compressed.

In another embodiment, both the guide bearing element and the injection valve element can be embodied as cones, with the clearance between the guide bearing element and the injection valve able for example to be selected to be constant or variable.

FIG. 1 shows a section of a fuel injection device 10 in accordance with the prior art. In this case, the fuel injection device 10 has a nozzle body device 12. In this case, an injection valve element 14 is arranged in a movable manner in the nozzle body device 12. In this process, a fuel to be injected is conveyed via a nozzle chamber inlet 16 into the nozzle chamber 18 that surrounds the injection valve element 14 and forms a ring gap as shown in FIG. 1.

In the area of the nozzle chamber 18, to which a system pressure is applied, i.e. the fuel pressure level prevailing in a high pressure reservoir or in the common rail system, an additional pressure stage is formed. By means of the system pressure prevailing in the nozzle chamber the injection valve element 14 can be put under pressure in the opening direction. Provision has for example been made for a piezoactuator (not shown) in order to control the injection valve element 14 and to inject fuel. When a current is applied to the piezoactuator in a suitable manner, the injection valve element 14 can be moved in accordingly so that fuel can be injected into a cylinder connected to it.

The pairing of the nozzle body device 12 with the injection valve element 14 enables a smaller clearance to be achieved in the ring gap. Since in the case of future applications or applications to be expected the system pressure will increase further and in such applications will lie at 1800 bar and higher, a further increase in the leakage must be taken into account in the embodiment shown in FIG. 1. Therefore, further measures are required in order to counter leakage in a suitable manner even in the case of a very high system pressure.

Figure 2:
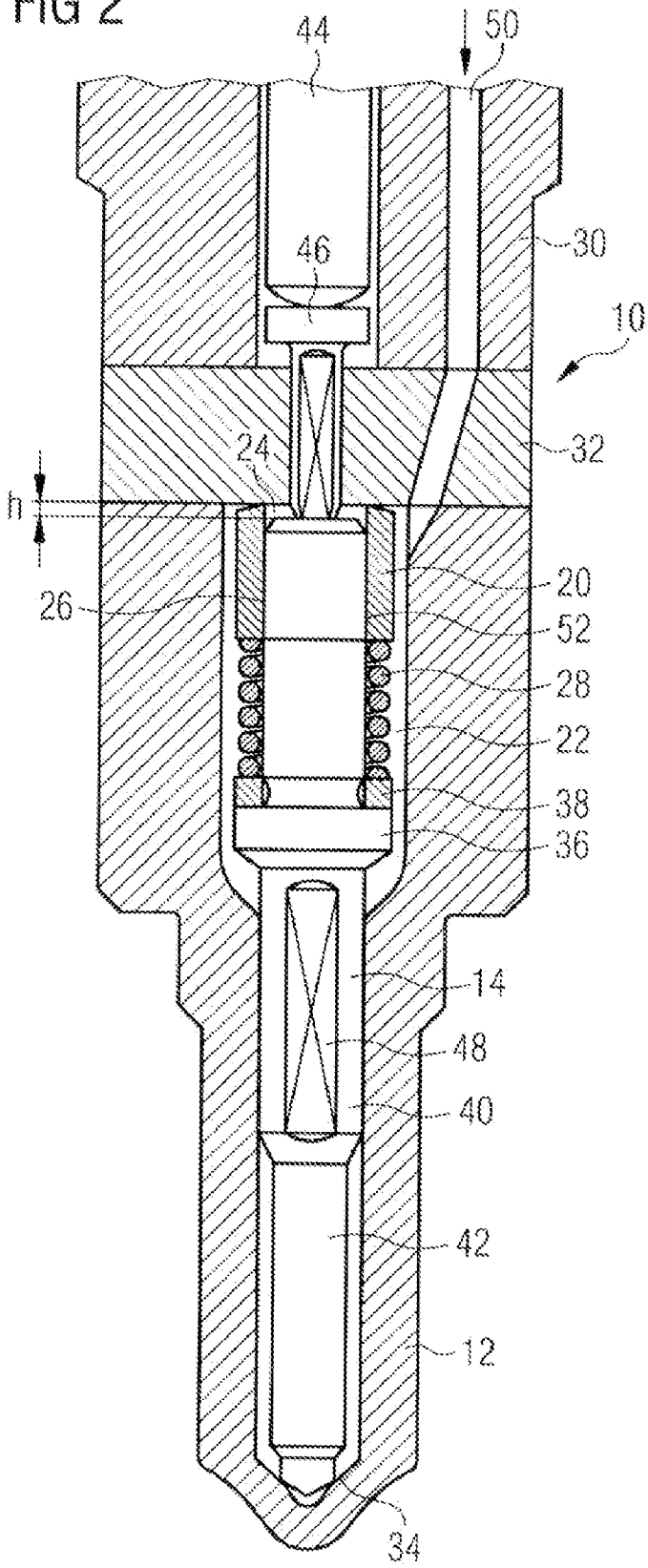
FIG. 2 shows a fuel injection device in a cross-sectional view in accordance with a first embodiment.

FIG. 2 now shows a sectional view of a first embodiment in accordance with the fuel injection device 10.

In this case, the fuel injection device 10 has a nozzle body device 12 in which an injection valve element 14 can be arranged in a movable manner or can slide back and forth. Provision has been made here for a guide bearing element 20, which divides the fuel injection device 10 into a high pressure chamber 22 and a low pressure chamber 24 as shown in FIG. 2. For this purpose, the injection valve element 14 is paired with the guide bearing element 20 for example in a first or upper section 26 (nozzle needle collar) of the injection valve element 14. The high pressure chamber 22 is formed here for example in an area or a ring gap around the injection valve element 14 and at least one part or essentially the entire outside of the guide bearing element 20. On the other hand, the low pressure chamber 24 is for example formed between the injection valve element 14 and the inside of the guide bearing element 20. In this embodiment, the low pressure chamber 24 corresponds to a leakage chamber in which a medium, for example fuel, which is found in the high pressure chamber 22 can penetrate through a gap 52 between the guide bearing element 20 and the injection valve element into the low pressure chamber 24.

The guide bearing element 20 is pressed for example by means of a spring element 28 against the injector body device 30 or a corresponding stop element 32 for example essentially forming a seal to seal off the high pressure chamber 22 and the low pressure chamber 24 from each other. In addition, the spring element 28 presses the injection valve element 14 against a nozzle body seat 34 so that one injection opening or a number of injection openings (not shown) of the fuel injection device 10 are closed.

The spring element 28 can for example exert a spring force of 30N. However, this value is only an example and the invention is not limited to it. In principle, the spring force can be selected smaller than or larger than 30N. The spring force is for example selected in such a way that the guide bearing element 20 can press sufficiently strongly against the injector body device 30 or the stop element 32 so that the low pressure chamber 24 is for example sealed off essentially from the high pressure chamber 22 by means of the guide bearing element 20. In this case, at least one stop disc can for example be used as the stop element 32 as shown in FIG. 2.

The injection valve element 14 typically has a collar section 36 on which the spring element 28 is arranged and presses against the guide bearing element 20 or the latter presses to form a seal against the stop element 32 of the injector body device 30. In addition, between the collar section 36 and the spring element 28, provision can be made for an adjusting element 38 as an option as shown in FIG. 2. The adjusting element 38, which is at least one adjusting disk, serves to adjust the spring element 28 or its spring deflection in a suitable manner so that that the spring element 28 for example presses the guide bearing element 20 sufficiently against the injector body device 30 or its stop element 32.

The clearance between the injection valve element 14 or its first upper section 26 and the guide bearing element 20 lies for example during manufacture or on assembly (at 0 bar) in a range between 7 μm and 8 μm. The range is however only an example. In principle, the clearance can also be smaller than 7 μm and/or larger than 8 μm. If during operation, the high pressure chamber 22 is pressurized with a corresponding pressure or fuel pressure for example exceeding 1800 bar or exceeding 2000 bar, the guide bearing element 20 is compressed. By the compression of the guide bearing element 20 following the pressure, the clearance between the guide bearing element 20 and the injection valve element 14 or in this case, its first, upper section 26 is reduced or decreased. For example, a clearance between the guide bearing element 20 and the injection valve element 14 from 7 μm to 8 μm on assembly (at 0 bar) is reduced for example to a clearance in a range for example from 1 μm to 2 μm at a pressure of 2000 bar. In other words, high fuel pressures bring about a reduction of the clearance here and for this reason a reduction of the leakage between the high pressure chamber 22 and the low pressure chamber 24 of the fuel injection device 10.

In addition, the injection valve element 14 is paired in the area of the nozzle shaft or in a second, middle section 40 with the nozzle body device 12. The clearance between the second, middle section 40 of the injection valve element 14 and the nozzle body device 12 for example lies in a range between 2 μm and 3 μm on assembly and is for example smaller than the clearance between the guide bearing element 20 and the injection valve element 14. However, this is not absolutely necessary, the clearance may also be greater or equal to the clearance between the guide bearing element 20 and the injection valve element 14. In addition, the clearance can also be smaller than 2 μm and/or larger than 3 μm.

Preferably the injection valve element 14 is arranged in the fuel injection device 10 at least in an area so that it can for example not tip over. In the present case, as shown in FIG. 2, the injection valve element 14 is paired with the nozzle body device 12 and is guided accordingly.

As shown further in FIG. 2, the injection valve element 14, adjoining the second section 40 has a third section or a lower section 42, which forms a gap or a ring gap together with the nozzle body device 12. The injection valve element 14 sits, as shown in FIG. 2, at its end on the nozzle body seat 34 and in doing so closes the relevant injection opening or injection openings (not shown) in order to inject the fuel into a connected cylinder.

In the closed position depicted in FIG. 2, which represents the initial position of the injection valve element 14, the distance between the front end of the first section of the injection valve element 14 and the injector body device 30 or the stop element 32 refers to the stroke h of the injection valve element 14.

In order to now move the injection valve element 14 from the closed position, as shown in FIG. 2 to an open position in which fuel can be injected, the injection valve element 14 is controlled by a corresponding control device (not shown). The control device for example has a piezoactuator or another suitable actuator.

In this case the control device can be connected to a control piston element 44, which on the other hand can control an additionally provided stroke adjusting pin element 46. The stroke adjusting pin element 46 is arranged in a movable manner between the control piston element 44 and the injection valve element 14 and is moved upwards in order to move the injection valve element 14 to an open position or downwards in order to move the injection valve element 14 to a closed position. In this case, the stroke adjusting pin element 46 can for example be paired with the stop element 32 or the injector body device 30 of the fuel injection device 10. The stroke adjusting pin element 46 can for example have one recess or a number of recesses in the form of beveled surfaces or cavities here, as shown in FIG. 2, in order to let a fluid pass through into the low pressure chamber 24 or from the low pressure chamber 24.

In order now to move the injection valve element 14 from the closed position to the open position, the control piston element 44 is moved upwards and back by means of the control device. In this process, the stroke adjusting pin element 46 is also moved backward accordingly and the injection valve element 14 upwards or also backward. In addition, the injection valve element 14 in this way compresses the spring element 28 it being possible that the sealing action of the guide bearing element 20 is supported further by pressing the guide bearing element 20 against the stop element 32 of the injector body device 30.

While the injection valve element 14 opens the corresponding injection opening, fuel can be injected from the gap between the injection valve element 14 and the nozzle body device 12 into an assigned cylinder. In this way, the fuel can for example be fed by a common rail system to the high pressure chamber 22, which is connected to the fuel injection device 10 by means of a fuel supply 50. From the high pressure chamber 22, the fuel arrives along the injection valve element 14 into the gap between the injection valve element 14 and the nozzle body device 12.

In order to convey the fuel from the high pressure chamber 22 into the gap, the injection valve element 14 has for example in the area of the pairing with the nozzle body device 12 at least one, two, three, four or a number of recesses 48, for example in the form of beveled surfaces 48 and/or cavities. Over these beveled surfaces 48 or cavities of the otherwise cylindrical second or middle sections of the injection valve element 14, the fuel can arrive in the lower gap or ring gap. However, in principle, any other form or device can be provided to feed the fuel in the area of the lower gap or ring gap. The beveled surfaces 48 represent only one example of many possibilities.

During operation, the guide bearing element 20 undergoes elastic deformation. In this process, the guide gap 52 or the ring gap becomes smaller between the guide bearing element 20 and the injection valve element 14. For example, the gap 52, which during manufacture at 0 bar has a clearance in a range for example from 7 μm to 8 μm, as described previously at a pressure of for example 2000 bar during operation is reduced to a gap with a clearance for example in a range from 1 μm to 2 μm. This has the advantage that in particular a reduction of the leakage can be achieved even in the case of high pressures of for example up to 2000 bar and higher. Essentially, a design without spikes can be achieved and as a result, the high pressure resistance can thus be improved. By implementing smaller guide diameters, at a simultaneous reduction of the control piston element diameter, the load of the seat can be reduced.

Figure 3:
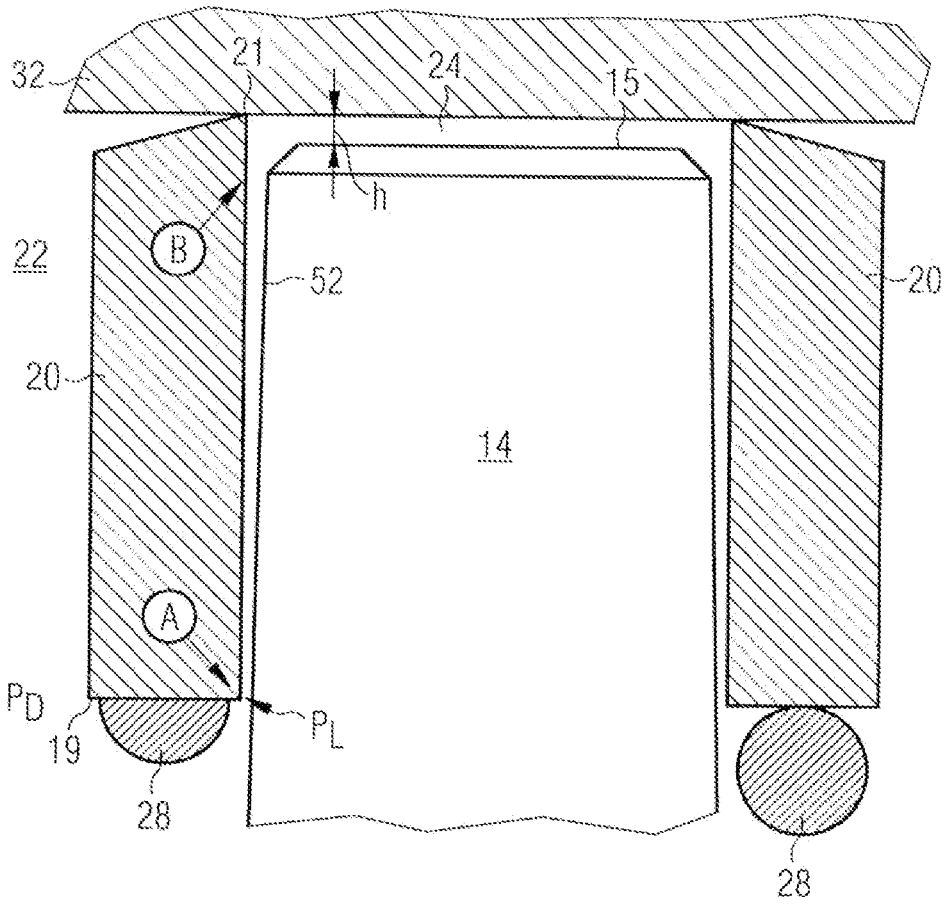
FIG. 3 shows a section of a guide bearing element and an injection valve element of a second embodiment of the fuel injection device.

FIG. 3 shows a section of a guide bearing element 20 and an injection valve element 14 of a second embodiment of the fuel injection device 10. In this case the injection valve element 14 is shown in a closed position, i.e. in a position in which the corresponding injection opening or injection openings of the fuel injection device 10 are closed. The injection valve element 14 and the guide bearing element 20 assume the same position here as in FIG. 2.

The second embodiment of the fuel injection device 10 differs here from the first embodiment in that the guide bearing element 20 and the injection valve element 14 are in the first embodiment essentially embodied as a cylinder or the guide gap 52 between the guide bearing element 20 and the injection valve element 14 is essentially embodied as a cylinder. As a result, what was said for the first embodiment in accordance with FIG. 2 also applies to the second embodiment in accordance with FIG. 3 and is consequently not repeated.

The guide bearing element 20 and/or the injection valve element 14 in the second embodiment as opposed to the first embodiment are essentially embodied as a cone or the guide gap 52 is essentially embodied as a cone between the guide bearing element 20 and the injection valve element 14.

In more precise terms, the injection valve element 14 can be embodied at least in the area in which said injection valve element is paired with the guide bearing element 20 as a cylinder (first embodiment) or as a cone (second embodiment). In this process, in the case of the first embodiment in the same way as in the case of the second embodiment, the inside of the guide bearing element 20 or the outside of the injection valve element 14 can for example in the area in which both are paired with each other or form the guide gap 52 also be embodied in steps. In this process, the steps can for example be embodied as a cylinder or as a cone or both can be combined depending on the function and the purpose of application. An example is explained in more detail below in FIG. 8. In principle, the form of the guide gap 52 and thus the embodiment of the guide bearing element 20 and the injection valve element 14 may vary at random depending on the function and the purpose of application.

In the case of the second embodiment, the guide bearing element 20 can in this way be embodied as a cylinder and the injection valve element 14 can at least in the area of the pairing with the guide bearing element 20 be embodied as a cone or vice versa. As an alternative, the guide bearing element 20 and the injection valve element 14 can at least also be embodied as a cone in the area of its pairing (not shown).

In other words, in accordance with various embodiments, the guide gap 52 between the guide bearing element 20 and the injection valve element 14 can for example be designed as a cone or as a cylinder or have any form, depending on the function and the purpose of application. This may apply to all the embodiments. The guide gap 52 can be designed as a cone in this way for example by explicit grinding into a cone of the needle or the injection valve element 14, as is subsequently for example shown in FIG. 4. Likewise, it is possible to grind the guide bearing element 20 into a cone. In the case of high pressures ranging from 1000 bar up to 2000 bar and higher, the guide bearing element 20 is for example deformed in such a way that essentially a constant guide gap 52 is brought about between the injection valve element 14 and the guide bearing element 20. The thickness of the guide bearing element 20 can for example lie in a range between approximately 1 mm and approximately 1.2 mm or 1 mm and 1.4 mm. This likewise may apply to all the embodiments.

In FIG. 3, the injection valve element 14 is at least embodied as a cone in the area of the pairing with the guide bearing element 20 it being possible that the injection valve element 14 in this way, for example, tapers in an upwards direction. On the other hand, the guide bearing element 20 is for example embodied as a cylinder.

The clearance between the guide bearing element 20 or its first, lower end 19 and the injection valve element 14 for example lies in a range from 2 μm to 3 μm or at approximately 3 μm. On the other hand, the clearance between the guide bearing element 20 or its second, upper end 21 and the injection valve element 14 for example lies in a range of approximately 12 μm.

In FIG. 3 the clearance between the guide bearing element 20 and the injection valve element 14 is not drawn. The first, for example larger clearance is designed as the gap between the second, upper end 21 of the guide bearing element 20 and the end 15 of the injection valve element 14. The second, for example smaller clearance is designed in a corresponding manner as the gap between the first, lower end 19 of the guide bearing element 20 and the injection valve element 14. It means that the clearance in the guide gap 52 can vary.

If during operation the fuel injection device 10 of the high pressure chamber 22 is now subjected to a pressure or nozzle internal pressure $P_D$ of for example 2000 bar, then in this way the leakage pressure $P_L$ corresponds in an area A of the guide bearing element 20 and the injection valve element 14 almost to the nozzle internal pressure $P_D$. Here, for example hardly any deformation of the guide bearing element 20 takes place. The clearance between the guide bearing element 20 and the injection valve element 14 at the first, lower end 19 can therefore be selected for example comparably small, for example in a range from 2 μm to 3 μm or at approximately 3 μm. However, these values are only by way of examples. In principle, the clearance can also be selected smaller than 2 μm and/or larger than 3 μm.

The leakage pressure $P_L$ in the area B is for example reduced essentially to a value of 10 bar because of the deformation or the compression of the guide bearing element 20 because of the nozzle internal pressure for example. The largest deformation of the guide bearing element 20 or the strongest compression of the guide bearing element takes place in the area B of the injection valve element 14. Therefore, the clearance between the injection valve element 14 and the guide bearing element in the area of the second, upper end 21 can be selected larger for example in a range around approximately 12 μm as the clearance in the range of the first, lower end 19 in which the injection valve element 14 and the guide bearing element 14 are paired.

However, in the case of the second embodiment the clearance between the guide bearing element 20 and the injection valve element 14 can be varied in a suitable manner so that an optimal reduction of the leakage can be achieved. In principle, the clearance between the guide bearing element 20 and the injection valve element 14 can however also be constant, in the same way as in the first embodiment in which the guide bearing element 20 and the injection valve element 14 are at least embodied as a cylinder in the area where they are paired.

The present invention is not limited to the embodiments shown in FIGS. 2 and 3. However, it is also for example possible to embody the control piston element 44 and the stroke adjusting pin element 46 as one part. Essentially, it is also possible to embody the stop element 32 as one part of the injector body device 30. Essentially, the recesses 48 at the second, middle section 40 of the injection valve element 14, which is paired with the nozzle body device 12, are embodied in any form and dimensions in so far as sufficient fuel can be conducted via the high pressure chamber 22 into the gap between the injection valve element 14 and the nozzle body device 12. The same also applies to the recesses at the control piston element 44 in a corresponding manner.

In principle, the fuel injection device 10 can be embodied in any manner, which for example relates to the control device (piezoactuator, etc.) and the control elements 44, 46, 28, 38 in order to control the adjusting valve element 14. It is conclusive that a guide bearing element 20 is provided on the injection valve element 12, which for example separates two chambers or a number of chambers 22, 24, for example essentially to form a seal and that by a pressure on its outside, a fuel pressure is for example compressed it being possible that the clearance between the guide bearing element 20 and the injection valve element 14 is reduced. The injection valve element 14 can be embodied in one part as in FIG. 2 or also for example consist of two parts or a number of parts depending on the function and the purpose of application.

Essentially, the guide bearing element 20 in the embodiments as described with reference to FIGS. 2 and 3 can for example have a wall strength in a range from approximately 1 mm to 1.2 mm. However, this value is only exemplary. In principle, the wall strength of the guide bearing element can also be selected smaller than 1 mm and/or larger than 1.2 mm. Essentially, the guide bearing element 20 can in accordance with various embodiments for example consist of 18CrNi8 or at least show this. However, other materials or metal alloys are also possible.

Figure 4:
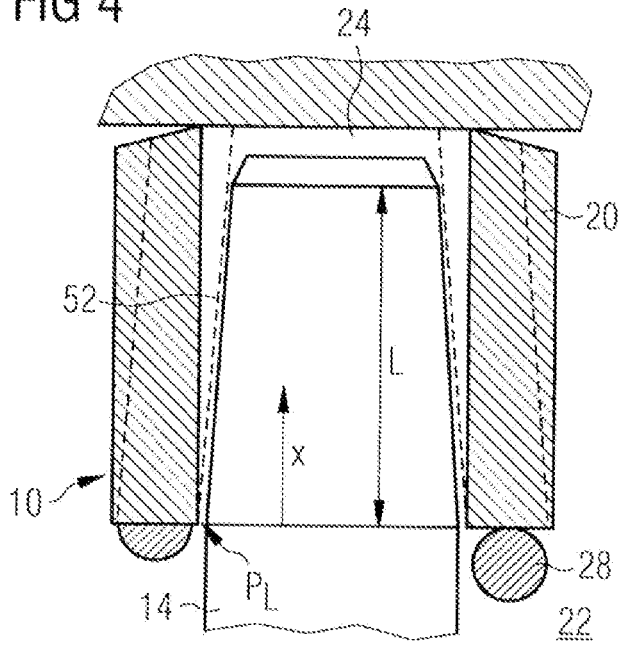
FIG. 4 shows a section of the guide bearing element and its injection valve element in accordance with FIG. 3.

Essentially, in FIG. 4 a section of the guide bearing element 20 and its injection valve element 14 is shown in accordance with FIG. 3. In this process, the injection valve element 14 is embodied at an end section as a cone, whereas the guide bearing element 20 is embodied as a cylinder. However, in principle the guide bearing element 20 can also be embodied on the inside as a cone. In this way, the guide gap 52 between the guide bearing element 20 and the injection valve element 14 is embodied as a cone.

In the first embodiment, by contrast with the second embodiment, the guide gap 52 is embodied as a cylinder because both the injection valve element 14 and said section in which it is paired with the guide bearing element 20 is embodied as a cylinder and the guide bearing element 20 is likewise embodied in this range as a cylinder. In principle, the guide gap 52 can be embodied in any way or may vary depending on the function and the purpose of application. This may apply to all the embodiments.

In FIG. 4, the fuel injection device 10 is for example subjected to a nozzle internal pressure of for example approximately 2000 bar. This results in a deformation of the guide bearing element 20. In this case, the deformation of the guide bearing element 20 is depicted with a dotted line in FIG. 4. The depiction of the guide bearing element 20 with the solid line shows the guide bearing element 20 when it is not subjected to a pressure or the nozzle internal pressure essentially is for example 0 bar.

In other words, in the present case pressure was applied to the fuel injection device 10. That is fuel was conducted into the fuel injection device 10, for example at a pressure of approximately 2000 bar. The pressure of the fuel in the high pressure chamber 22 of the fuel injection device 10 results in the guide bearing element 20 being compressed (dotted line) and as a result a leakage or a leakage pressure $P_L$ being reduced, in this case for example a leakage from the high pressure chamber 22 into the low pressure chamber 24. At a high pressure of for example 2000 bar, the guide bearing element 20 is deformed in such a way that an almost constant or nearly constant or essentially constant guide gap 52 occurs. The length L here characterizes the area of the pairing between the guide bearing element 20 and the injection valve element 14 or the entire length of the guide gap 52. In the example, as shown in FIG. 4, the fuel injection device 10 is shown in the closed position, which represents the outlet position of the injection valve element 14. On the other hand, the path X represents the straight line of the guide gap 52. In this case the guide gap 52, as described above, forms the gap between the injection valve element 14 and the guide bearing element 20.

Figure 5:
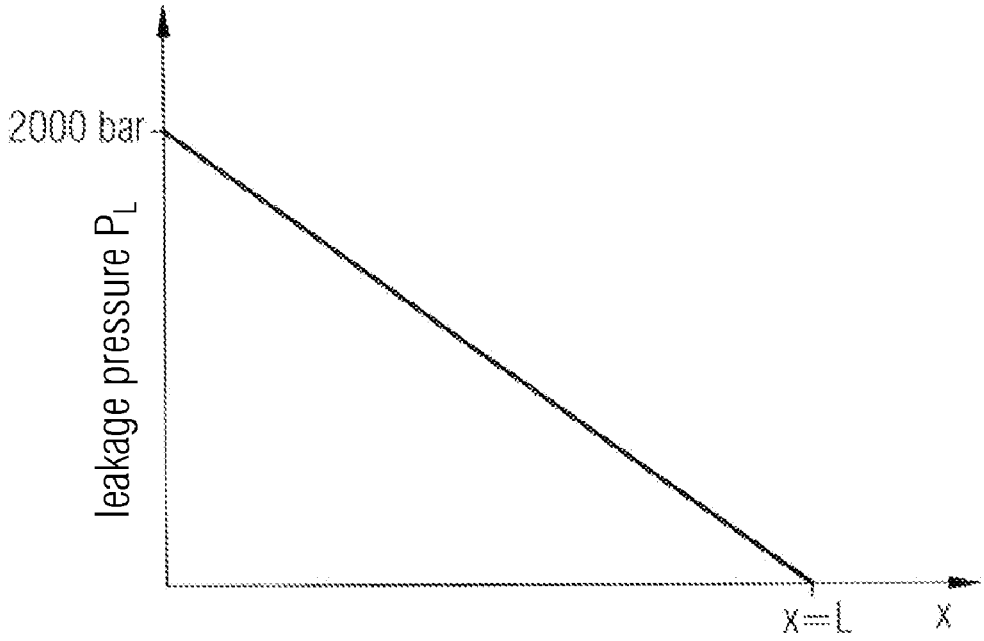
FIG. 5 shows a diagram in which the course of the leakage pressure is represented when pressure is applied to the fuel injection device.

FIG. 5 now shows a schematic simplified diagram in which the graph of the leakage pressure $P_L$ is shown when pressure is applied to the fuel injection device 10, for example a pressure of approximately 2000 bar.

As can be seen from the diagram in FIG. 5, the leakage pressure $P_L$ at the beginning of the guide gap 52 is the largest or at the beginning of the straight line X of the guide gap, here at X=0. Higher up, the guide bearing element is compressed to a correspondingly greatly degree by applying pressure so that the leakage pressure $P_L$ decreases over the length L of the guide gap up to the end of the guide gap or X=L. In this process, the leakage pressure at the end of the guide gap or at X=L can essentially be zero or almost zero so that essentially no leakage occurs between the high pressure chamber and the low pressure chamber.

Figure 6:
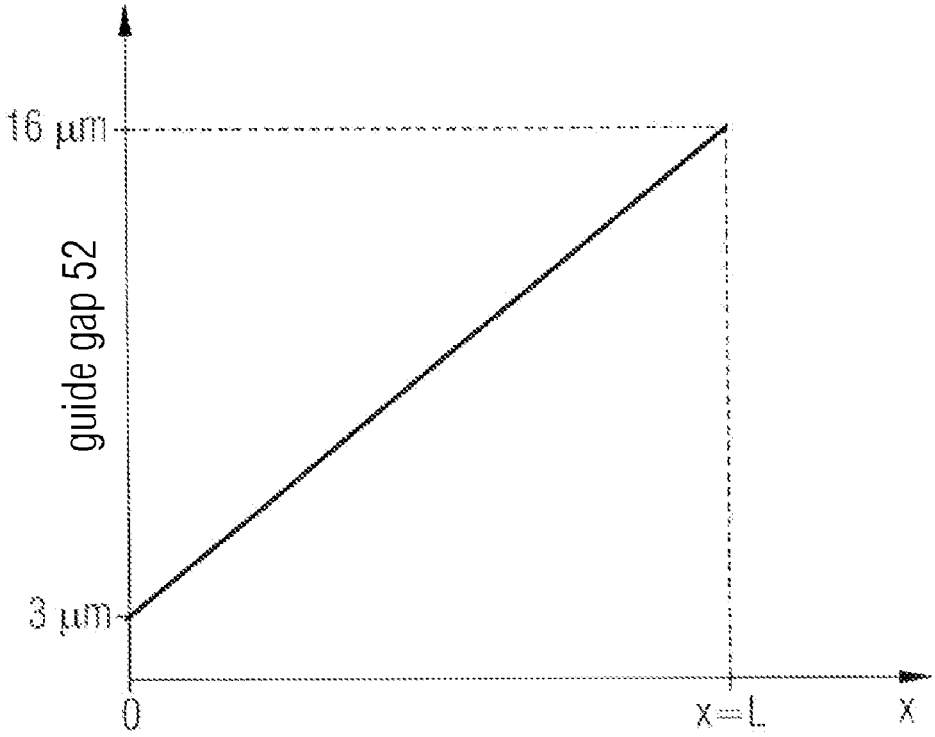
FIG. 6 shows a diagram in which the course of a guide gap is represented between the guide bearing element and the injection valve element.

Essentially, FIG. 6 shows a schematic simplified diagram in which a guide gap is shown which is not constant over its length L, but varies.

In this case, it can be taken from the diagram in FIG. 6 that a guide gap between the guide bearing element and the injection valve element has at the beginning, i.e. at X=0, a guide gap of for example 3 μm. The guide gap increases in accordance with FIG. 6 towards its end at X=L to a gap size of 16 μm. That means the guide gap increases gradually towards its end. The guide gap can be shown larger towards its end (X=L) than at its beginning (X=0) because it is increasingly compressed towards its end (X=L) than in its beginning area. In principle, the guide gap can be embodied over its length but can also be embodied in a constant manner.

Figure 7:
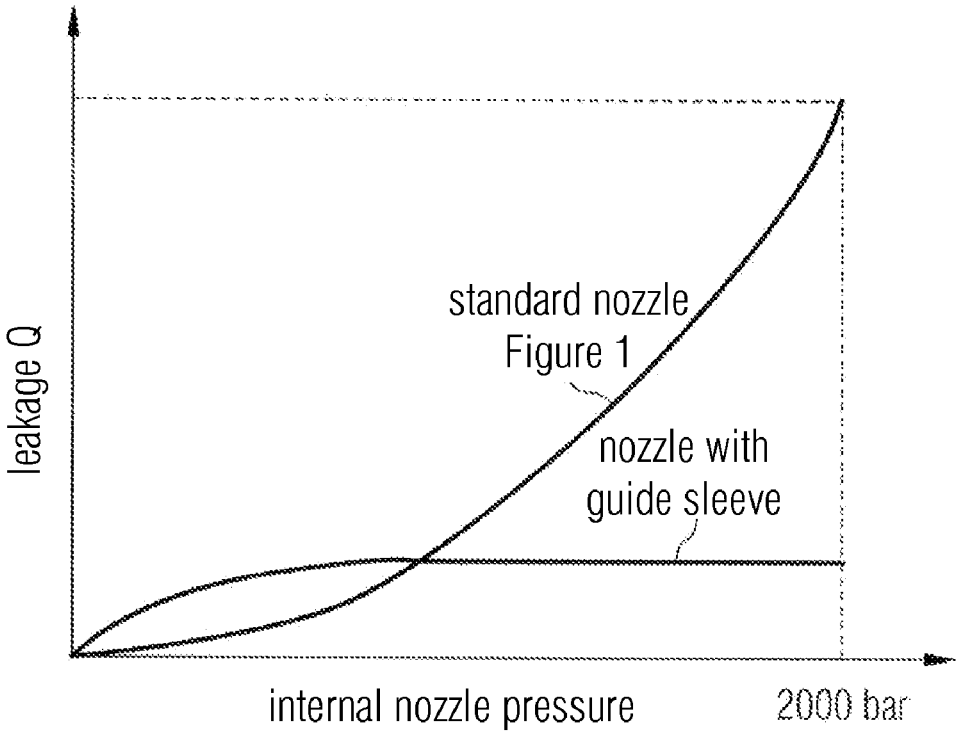
FIG. 7 shows a diagram in which the leakage in a standard fuel injection device in accordance with FIG. 1 and a fuel injection device in accordance with FIGS. 2 and 3 is depicted.

Further FIG. 7 shows a schematically simplified diagram in which the leakage is shown for a standard fuel injection device in accordance with FIG. 1 and a fuel injection device in accordance with various embodiments.

As can be seen from FIG. 7, the leakage Q increases strongly at a standard nozzle or a standard fuel injection device in accordance with FIG. 1 as the nozzle internal pressure increase. In particular, when pressure is applied with pressures exceeding 1000 bar or pressures of up to 2000 bar, the leakage Q at the standard fuel injection device increases significantly in accordance with FIG. 1. In the case of the fuel injection device in accordance with various embodiments, the leakage Q increases instead only slightly at lower pressures because the guide bearing element in this range according to the low pressure or to the small pressure application is not so strongly compressed or only slightly compressed. When slightly higher pressures are reached and in particular on reaching high pressures of 1000 bar and higher up to for example 2000 bar, the leakage Q essentially no longer increases but remains at a slight leakage value Q as shown in FIG. 7. As a result, the leakage Q can in particular be reduced significantly at high pressures of 1000 bar and higher compared to the leakage Q as they occur at standard fuel injection devices, in accordance with FIG. 1. On the other hand, the standard fuel injection devices provide only at comparably small nozzle internal pressures, a reduction of the leakage Q, whereas on the other hand it increases drastically at high nozzle internal pressures.

Figure 8:
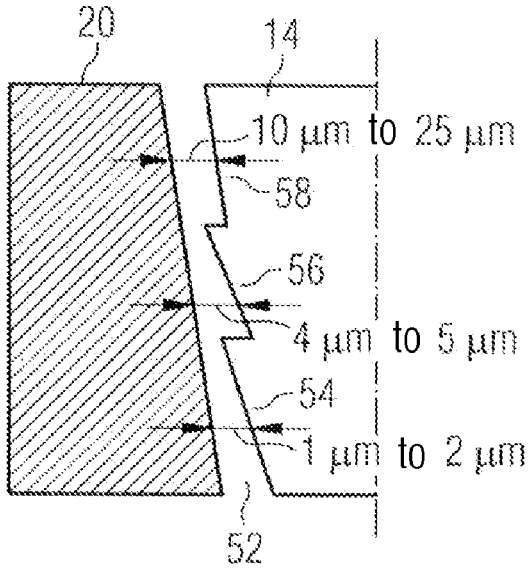
FIG. 8 shows a section of the injection valve element and the guide bearing element, with the guide gap being embodied as a stepped design.

FIG. 8 essentially shows a section of a guide bearing element 20 and an injection valve element 14. In this diagram the guide bearing element 20 and the injection valve element 14 form a guide gap 52 that has a variable cross section. In more exact terms, in the example shown in FIG. 8, the outside of the injection valve element 14 is embodied as a stepped design, for example in the form of conical or beveled steps 54, 56, 58. However, in principle the steps can also for example be embodied tapered in cylindrical steps. Essentially, the inside of the guide bearing element 20 is likewise for example embodied as a cone. By the same token, the guide bearing element 20 can be embodied on its inside but also as a cylinder.

FIG. 8 for example makes provision for three steps 54, 56, 58, with the first step 54 for example having a guide gap section with a clearance for example in a range from 1 μm to 2 μm. The second step 56 forms a guide gap section with a larger clearance than the clearance of the first step 54, for example a clearance in a range from 4 μm to 5 μm. In addition, the third step 58 forms a guide gap section with a clearance which is larger than the clearance of the first and the second step 54, 56, for example a clearance in a range from 10 μm to 25 μm. The reason for this is that in the present case, the guide bearing element 20 in the upper range is compressed the strongest when pressure is applied to the fuel injection device, whereas the lower range of the guide bearing element 20 is compressed less strongly and therefore the clearance would be smaller to appropriately prevent a leakage or to at least reduce it.

As a result, the clearance of the guide gap 52 increases in the present example from the bottom to the top. However, in principle it can also take place in the opposite direction depending on the function and purpose of application. The values for the specific clearance of the first, the second and the third steps 54, 56, 58 are only exemplary and the invention is not limited thereto.

Essentially, provision can also be made for the tapering in a corresponding manner on the inside of the guide bearing element 20 (not shown) instead of at a section of the outside of the injection valve element 14. However, it is also possible that provision can be made for a tapering on the inside of the guide bearing element 20 and on the corresponding outside of the injection valve element 14 (not shown).

Essentially, provision can be made for at least two, three or a number of steps 54, 56, 58, which are for example embodied as a cone and/or as a cylinder or can have a conical and or a cylindrical section. Essentially, a conical tapering of the injection valve element 14 with a cylindrical inner wall of the guide bearing element 20 can be combined and vice versa.

In the same way, a cylindrical tapering of the injection valve element 14 with a cylindrical or a conical inner wall of the guide bearing element 14 can be combined and vice versa.

What is claimed is:

1. A fuel injection device for injecting fuel into the combustion chamber of an internal combustion engine, wherein the fuel injection device has an injection valve element with a first section, on which a guide bearing element is arranged, with a first pressure chamber being provided in an area around the guide bearing element, wherein a clearance between the guide bearing element and the first section of the injection valve element is reducible by applying pressure to the first pressure chamber at a pressure of 1000 bar or higher.

2. The fuel injection device according to claim 1, wherein the first pressure chamber is around an area of the guide bearing element or the area around a high pressure chamber.

3. The fuel injection device according to claim 1, wherein a second pressure chamber is formed between the inside of the guide bearing element and the end of the injection valve element, with the second pressure chamber being a low pressure chamber.

4. The fuel injection device according to claim 1, wherein the clearance between the guide bearing element and the first section of the injection valve element is reducible by applying pressure to the first pressure chamber in a range of between 1000 bar and 2000 bar.

5. The fuel injection device according to claim 1, wherein the injection valve element is arranged in a movable manner in a nozzle body device.

6. The fuel injection device according to claim 1, wherein the guide bearing element is pressed against an injector body device or an stop element can be pressed against the injector body device to seal it or essentially to form a seal.

7. The fuel injection device according to claim 1, wherein the injection valve element has a second section, which is paired with the nozzle body device, with the second section having one, two, three, four or a number of recesses for fuel to pass through with the recesses being embodied in the form of at least one of beveled surfaces and cavities.

8. The fuel injection device according to claim 1, wherein the injection valve element has a third section, which with its end in a closed position of the fuel injection device closes off the specific injection opening or the relevant injection openings of the fuel injection device.

9. The fuel injection device according to claim 8, wherein the third section of the injection valve element forms a gap or a ring gap with the nozzle body device.

10. The fuel injection device according to claim 1, comprising a piezoactuator to control the injection valve element.

11. The fuel injection device according to claim 1, comprising at least one fuel supply in the fuel injection device by means of which fuel is supplied to the high pressure chamber.

12. The fuel injection device according to claim 1, wherein at least one of the guide bearing element and the injection valve element are cylindrical or cylindrically tapered.

13. The fuel injection device according to claim 1, wherein at least one of the guide bearing element and the injection valve element are conical or conically tapered.

14. The fuel injection device according to claim 1, wherein the guide bearing element is embodied as a cylinder and the injection valve element at least in the area of the guide bearing element is embodied in a conical or in a conically tapered manner, with the cone being tapered upwards or towards the end.

15. The fuel injection device according to claim 1, wherein the guide bearing element is embodied as a cone and the injection valve element, at least in the area of the guide bearing element, is embodied in a conical or in a conically tapered manner, with the cone being tapered upwards or towards the end.

16. The fuel injection device according to claim 1, wherein the guide bearing element has a wall strength ranging from approximately 1 mm to approximately 1.4 mm.

17. The fuel injection device according to claim 1, wherein the guide bearing element comprises 18CrNi8.

18. A fuel injection device for injecting fuel into the combustion chamber of an internal combustion engine, comprising:

an injection valve element with a first section, on which a guide bearing element is arranged, with a first pressure chamber being provided in an area around the guide bearing element, at least one spring element configured to press the guide bearing element against an injector body device or a stop element associated with the injector body device, a collar associated with the injection valve element and configured to support the spring element, and at least one adjusting element arranged between the collar section and the spring element.

19. A fuel injection device for injecting fuel into the combustion chamber of an internal combustion engine, comprising:

an injection valve element with a first section, on which a guide bearing element is arranged, with a first pressure chamber being provided in an area around the guide bearing element, and a control piston element configured to control the injection valve element, a stroke adjusting pin element arranged in a movable manner between the control piston element and the injection valve element, the stroke adjusting pin element being slidably coupled to at least one of an injector body device and a stop element associated with the injector body device.

20. A fuel injection device for injecting fuel into the combustion chamber of an internal combustion engine, wherein the fuel injection device has an injection valve element with a first section, on which a guide bearing element is arranged, with a first pressure chamber being provided in an area around the guide bearing element, wherein at least one of (a) the clearance between the guide bearing element and the injection valve element lies in a range from 7 μm to 8 μm and (b) the clearance between the second section of the injection valve element and the nozzle body device lies in a range from 2 μm to 3 μm.

21. A fuel injection device for injecting fuel into the combustion chamber of an internal combustion engine, wherein the fuel injection device has an injection valve element with a first section, on which a guide bearing element is arranged, with a first pressure chamber being provided in an area around the guide bearing element, wherein at least one of (a) a first, lower end of the guide bearing element forms a clearance with the injection valve element that lies in a range from 2 μm to 3 μm and (b) a second, upper end of the guide bearing element forms a clearance with the injection valve element that lies in a range from 10 μm to 12 μm or 10 μm to 13 μm or 10 μm to 16 μm.

22. A fuel injection device for injecting fuel into the combustion chamber of an internal combustion engine, wherein the fuel injection device has an injection valve element with a first section, on which a guide bearing element is arranged, with a first pressure chamber being provided in an area around the guide bearing element, wherein a clearance of a guide gap between the guide bearing element and the first section of the injection valve element increases from one axial end of the guide bearing element to an opposite axial end of the guide bearing element.

23. The fuel injection device according to claim 22, wherein the clearance of the guide gap between the guide bearing element and the injection valve element increases in steps, wherein the clearance of the guide gap at a first step lies in a range from 1 μm to 2 μm, the clearance of the guide gap at a second step lying in a range from 4 μm to 5 μm and the clearance of the guide gap at a third step lies in a range from 10 μm to 25 μm.

* * * * *